US006152315A

United States Patent [19]

Montgomery

[11] Patent Number: 6,152,315

[45] **Date of Patent: *Nov. 28, 2000**

[54] CLOSURE HAVING BACK-ANGLED LUGS

[75] Inventor: Gary V. Montgomery, Evansville, Ind.

[73] Assignee: Rexam Plastics Inc., Evansville, Ind.

[ * ] Notice: This patent issued on a continued prosecution application filed under 37 CFR 1.53(d), and is subject to the twenty year patent term provisions of 35 U.S.C. 154(a)(2).

[21] Appl. No.: 08/949,629

[22] Filed: Oct. 14, 1997

[51] Int. Cl.[7] ..... B65D 55/02

[52] U.S. Cl. ..... 215/216; 215/217

[58] Field of Search ..... 215/216, 217, 215/219, 221, 330

[56] References Cited

U.S. PATENT DOCUMENTS

| | | | |
|---|---|---|---|
| 2,423,582 | 7/1947 | Coleman . | |
| 3,399,796 | 9/1968 | Steiner . | |
| 3,468,447 | 9/1969 | Smalley . | |
| 3,630,403 | 12/1971 | Berg . | |
| 3,830,391 | 8/1974 | Uhlig . | |
| 3,841,514 | 10/1974 | Montgomery et al. . | |
| 3,868,037 | 2/1975 | Grossman . | |
| 3,913,769 | 10/1975 | Scrocco et al. . | |
| 3,917,097 | 11/1975 | Uhlig . | |
| 3,941,268 | 3/1976 | Owens et al. . | |
| 3,958,708 | 5/1976 | LeBrun, Jr. . | |
| 3,984,021 | 10/1976 | Uhlig . | |
| 3,986,626 | 10/1976 | Montgomery . | |
| 4,116,351 | 9/1978 | Uhlig . | |
| 4,117,945 | 10/1978 | Mumford . | |
| 4,134,513 | 1/1979 | Mumford . | |
| 4,138,028 | 2/1979 | Price et al. . | |
| 4,149,646 | 4/1979 | Julian . | |
| 4,171,057 | 10/1979 | Gach . | |
| 4,172,533 | 10/1979 | Montgomery . | |
| 4,213,534 | 7/1980 | Montgomery . | |
| 4,345,690 | 8/1982 | Hopley . | |
| 4,353,475 | 10/1982 | Kachur et al. . | |
| 4,360,113 | 11/1982 | Luker . | |
| 4,383,618 | 5/1983 | Dougherty . | |
| 4,386,712 | 6/1983 | DeWallace . | |
| 4,410,097 | 10/1983 | Kusz . | |
| 4,436,211 | 3/1984 | Gach . | |
| 4,452,363 | 6/1984 | Davis | 215/216 |
| 4,464,316 | 8/1984 | Michaels . | |
| 4,479,585 | 10/1984 | Sandhaus . | |
| 4,545,496 | 10/1985 | Wilde et al. . | |
| 4,588,097 | 5/1986 | Hauser . | |
| 4,667,836 | 5/1987 | McLaren | 215/216 |
| 5,078,288 | 1/1992 | Fuchs . | |
| 5,082,130 | 1/1992 | Weinstein . | |
| 5,238,130 | 8/1993 | Marques et al. . | |
| 5,279,434 | 1/1994 | Aquirrezabel . | |
| 5,307,946 | 5/1994 | Molinaro . | |
| 5,394,999 | 3/1995 | Krall . | |
| 5,413,233 | 5/1995 | Hall . | |
| 5,551,582 | 9/1996 | Robinson | 215/216 |

FOREIGN PATENT DOCUMENTS

| | | |
|---|---|---|
| 0343778 | 11/1989 | European Pat. Off. . |
| 0787660 | 8/1997 | European Pat. Off. . |

*Primary Examiner*—Stephen K. Cronin
*Attorney, Agent, or Firm*—Middleton & Reutlinger; Charles G. Lamb; John F. Salazar

[57] ABSTRACT

A safety closure providing a top wall, an annular side skirt depending downwardly from an outer periphery of the top wall and defining a lower end thereof opposite the top wall, an internal thread projecting inwardly from an inner annular surface of the side wall, the internal thread being disposed towards the top wall, and at least one lug projecting inwardly from the side wall inner annular surface, the at least one lug defining an acute angle with the side wall inner annular surface, the at least one lug having a substantially trapezoidal profile, the substantially trapezoidal profile having a base edge disposed parallel to a central axis of the side wall and coincident therewith, a lower edge projecting inwardly from a lower end of the base edge, an inner edge parallel to the base edge and extending upwardly from an innermost end of the lower edge, and an angled edge connecting an upper end of the inner edge with an upper end of the base edge, the base edge upper end being vertically above the inner edge upper end.

9 Claims, 9 Drawing Sheets

CLOSURE HAVING BACK-ANGLED LUGS

BACKGROUND OF THE INVENTION

1. Technical Field of the Invention

The present invention relates to safety closures for use on containers. More particularly, the present invention relates to a safety closure for use on a container wherein the safety closure is provided with means to prevent removal of the safety closure from the container.

2. Discussion of the Prior Art

The use of cooperating locking lugs on safety closures and containers to prevent individuals of tender age from gaining access to the contents of the container is relatively well-known in the prior art. Typically, a safety closure is provided including a flexible annular skirt having an inner annular surface thereof and a pair of opposed locking lugs projecting inwardly therefrom. A container is also provided with a container neck portion having on an exterior surface thereof a pair of opposed, outwardly-projecting locking lugs. The safety closure of this type is threadingly engageable on the container neck portion until the closure locking lugs pass over and beyond their respective cooperating container locking lugs, thereby causing interference therebetween and preventing removal rotation of the safety closure relative to the container neck. Removal of the safety closure from the container neck requires an individual to first overcome the interference between the cooperating locking lugs and to then concurrently apply sufficient removal rotation to the safety closure relative to the container. It is therefore desirable to provide a safety closure for use on a container wherein the safety closure is provided with locking lugs to prevent removal of the safety closure from the container.

For example, U.S. Pat. No. 3,941,268 to Owens, et al., teaches a safety closure and a container having cooperating locking lugs to prevent removal of the safety closure from the container. More particularly, the locking lugs of the safety closure according to the Owens '268 patent project inwardly from an inner surface thereof along a plane substantially perpendicular thereto. Even further, the container locking lugs project outwardly from an outer surface thereof along a plane substantially perpendicular thereto. As such, the cooperating locking lugs interfere along a plane substantially perpendicular to either the safety closure inner surface or the container outer surface. Accordingly, very little flexing thereof is required before the cooperating locking lugs "skip" over one another. It is thus desirable to provide a safety closure for use on a container wherein the safety closure and the container are provided with cooperating locking lugs to prevent removal of the safety closure from the container and wherein the respective locking lugs are angled sufficiently relative to one another to enhance the interference therebetween.

For example, U.S. Pat. No. 4,213,534 to Montgomery teaches a child-resistant closure for use on a container wherein the closure is provided with internal back-angled lugs for engaging cooperating back-angled lugs provided on the container. However, it is furthermore desirable to provide a safety closure for use on a container wherein the safety closure is provided with back-angled locking lugs respectively having a height which is less than the height of the closure.

For example, U.S. Pat. No. 2,423,582 to Coleman teaches a bottle cap for use on a container wherein the bottle cap includes internal back-angled tongues for engaging cooperating sloping lugs provided on the container and wherein the back-angled tongues of the bottle cap do not extend the full longitudinal height of the bottle cap. However, it is furthermore desirable to provide a safety closure for use on a container wherein the safety closure is provided with locking lugs having a shape which permits efficient molding thereof.

SUMMARY OF THE INVENTION

It is an object of the present invention to provide a safety closure for use on a container wherein the safety closure is provided with locking lugs to prevent removal of the safety closure from the container.

It is another object of the present invention to provide a safety closure for use on a container wherein the safety closure and the container are provided with cooperating locking lugs to prevent removal of the safety closure from the container and wherein the respective locking lugs are angled sufficiently relative to one another to enhance the interference therebetween.

It is yet another object of the present invention to provide a safety closure for use on a container wherein the safety closure is provided with back-angled locking lugs respectively having a height which is less than the height of the closure.

It is still yet another object of the present invention to provide a safety closure for use on a container wherein the safety closure is provided with locking lugs having a shape which permits efficient molding thereof.

A safety closure according to the present invention includes a top wall, an annular side skirt depending downwardly from an outer periphery of the top wall and defining a lower end thereof opposite the top wall, an internal thread projecting inwardly from an inner annular surface of the side wall, the internal thread being disposed towards the top wall, and at least one lug projecting inwardly from the side wall inner annular surface, the at least one lug defining an acute angle with the side wall inner annular surface, the at least one lug having a substantially trapezoidal profile, the substantially trapezoidal profile having a base edge disposed parallel to a central axis of the side wall and coincident therewith, a lower edge projecting inwardly from a lower end of the base edge, an inner edge parallel to the base edge and extending upwardly from an innermost end of the lower edge, and an angled edge connecting an upper end of the inner edge with an upper end of the base edge, the base edge upper end being vertically above the inner edge upper end.

BRIEF DESCRIPTION OF THE DRAWINGS

A better understanding of the present invention will be had upon reference to the following description in conjunction with the accompanying drawings in which like numerals refer to like parts, and wherein.

DETAILED DESCRIPTION OF THE PREFERRED EMBODIMENT

Figure 1:
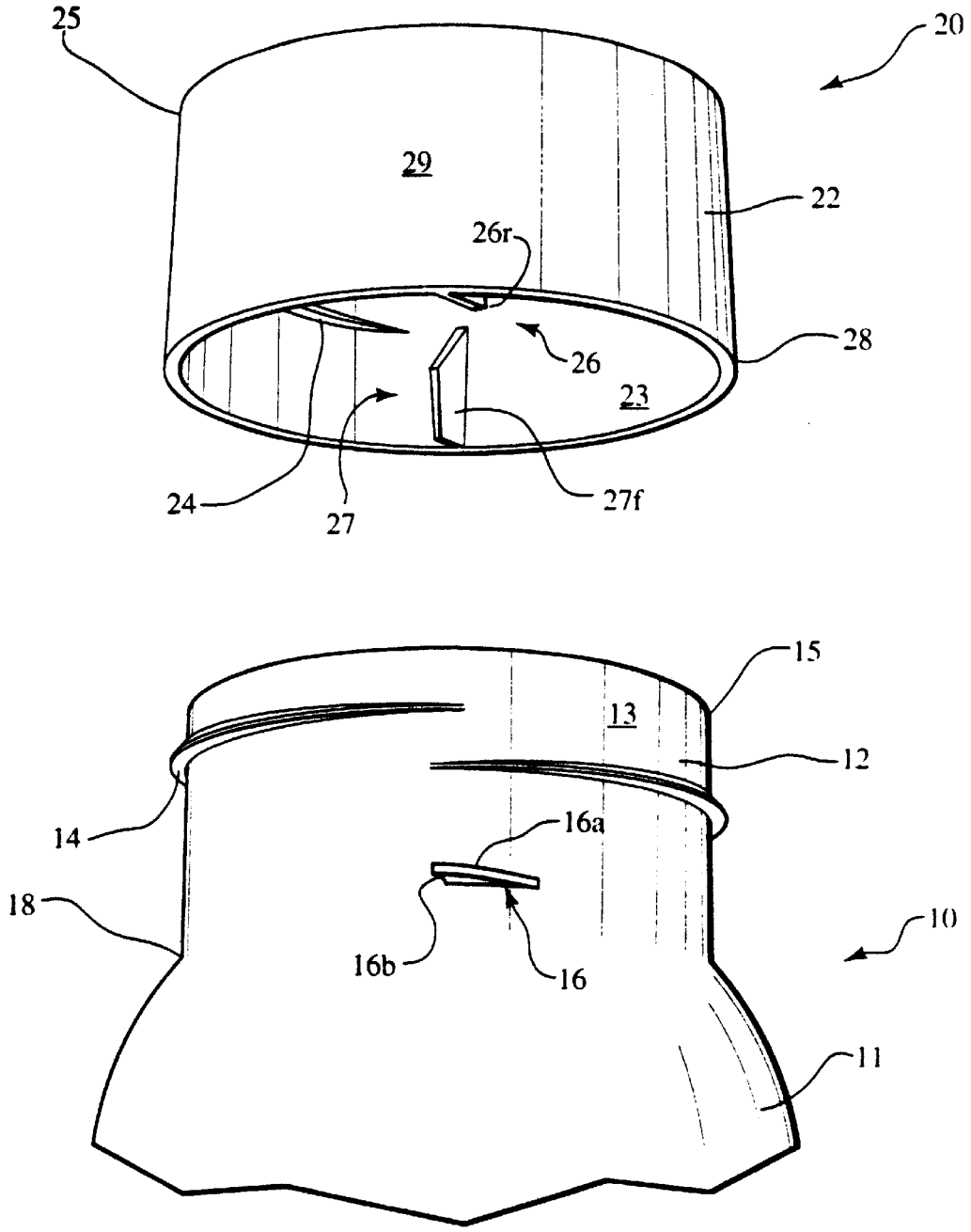
FIG. 1 is a perspective view of a closure according to the preferred embodiment of the present invention shown with a neck portion of a container.
Figure 2:
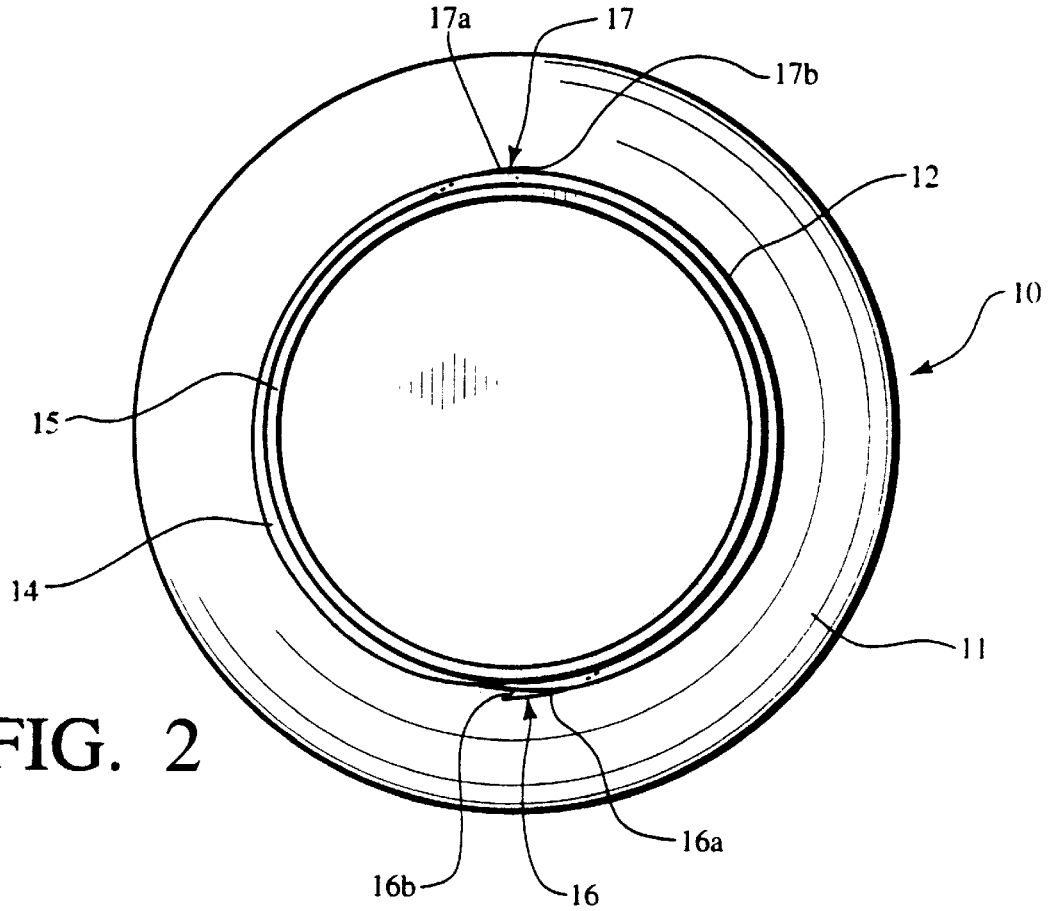
FIG. 2 is a top view of the container of FIG. 1.

With combined reference to FIGS. 1 and 2, there is shown a closure 20 according to a preferred embodiment of the present invention in spaced relation to a container 10. The closure 20 is preferably constructed from flexible plastic material having resilience, such as, for example, polyethylene or polypropylene. The container 10 includes a body portion 11 (partially shown) and a neck portion 12 having an outer surface 13 thereof, an external thread 14 disposed towards an upper end 15 of the neck portion 12 and projecting outwardly therefrom and a pair of diametrically-opposed locking lugs 16, 17 disposed towards a lower end 18 thereof adjacent to the container body portion 11 and projecting outwardly therefrom. The locking lugs 16, 17 include respective sloped faces 16*a*, 17*a* and opposing abutment faces 16*b*, 17*b*.

Figure 3:
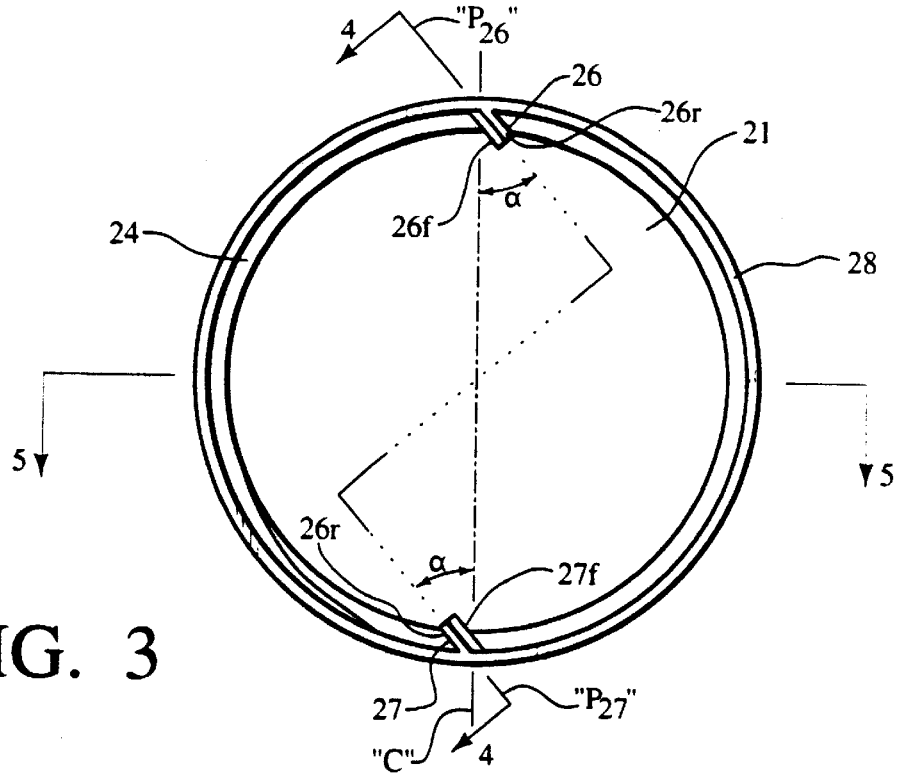
FIG. 3 is a bottom view of the closure of FIG. 1.

With combined reference to FIGS. 1 and 3, the closure 20 includes a top wall 21 having an outer periphery and an annular side wall 22 depending downwardly therefrom and defining a lower end 28 thereof. The side wall 22 includes an inner surface 23, an internal thread 24 disposed towards an upper end 25 of the side wall 22 and projecting inwardly therefrom, and a pair of diametrically-opposed locking lugs 26, 27 disposed towards the lower end 28 thereof and projecting inwardly therefrom. The side wall 22 further includes an outer surface 29, which may have axial ribs, knurls or other similar texturing to enhance a user's grip thereon. The closure internal thread 24 is dimensioned to threadingly engage the external thread 14 of the container neck portion 12, thereby securing the closure 20 to the container 10. The closure locking lugs 26, 27 are dimensioned to matingly engage the respective container locking lugs 16, 17, thereby preventing rotation of the closure 20 relative to the container 10.

More particularly, the closure locking lugs 26, 27 project inwardly from the inner surface 23 of the side wall 22 along respective planes "$P_{26}$", "$P_{27}$" respectively offset by an angle "$\alpha$" from a plane "C" connecting respective points of intersection between the locking lugs 26, 27 and the side wall 22. The closure locking lugs 26, 27 respectively include angled front surfaces 26*f*, 27*f* and opposing angled rear surfaces 26*r*, 27*r*.

Figure 4:
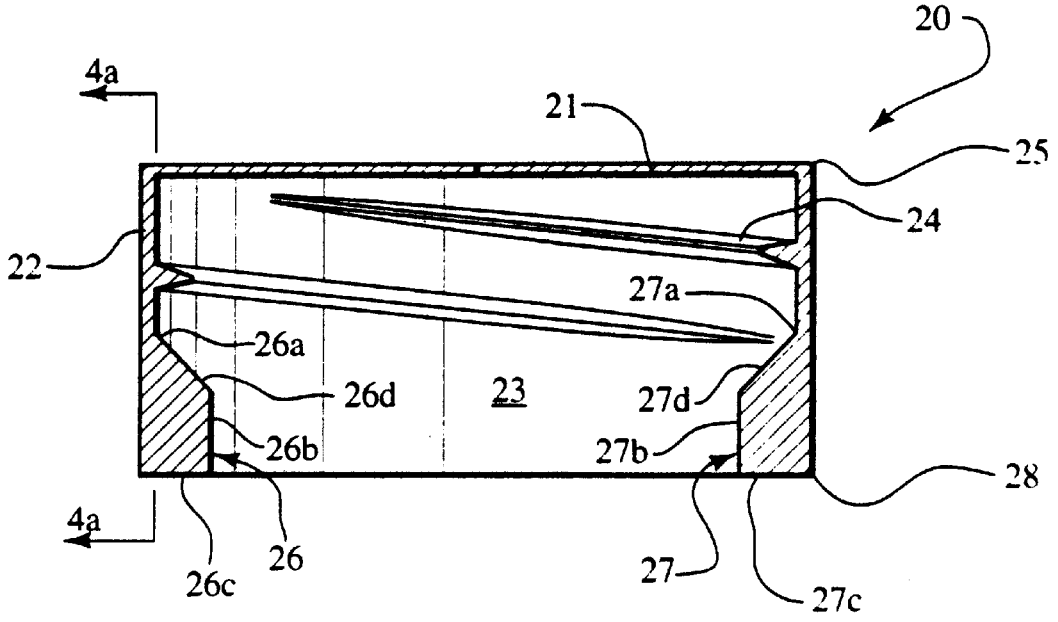
FIG. 4 is a section view of the closure of FIG. 1 taken along section line 4—4 of FIG. 3.
Figure 5:
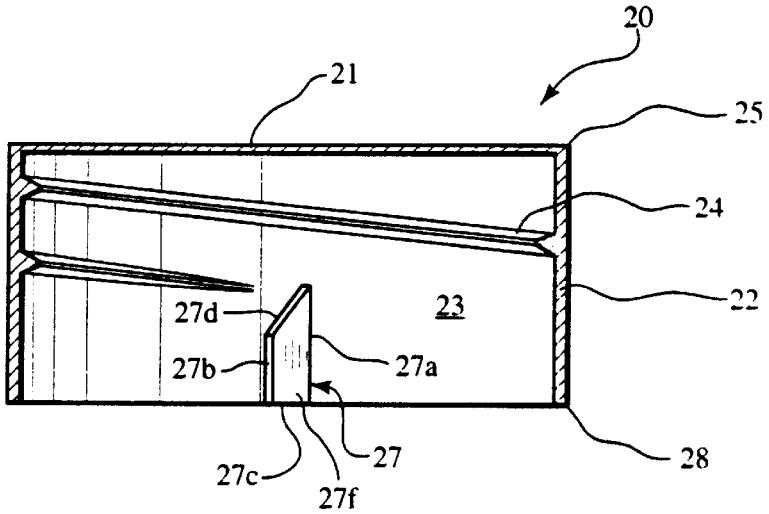
FIG. 5 is section view of the closure of FIG. 1 taken along section line 5—5 of FIG. 3.

With additional reference to FIGS. 4 and 5, the closure locking lugs 26, 27 respectively include a substantially trapezoidal profile having a base edge 26*a*, 27*a* integral with and coincident to the inner surface 23 of the side wall 22, an inner edge 26*b*, 27*b* parallel to and offset radially inwardly from the base edge 26*a*, 27*a*, a bottom edge 26*c*, 27*c* connecting respective lower distal ends of the base edge 26*a*, 27*a* and the inner edge 26*b*, 27*b*, and an angled edge 26*d*, 27*d* connecting respective upper distal ends of the base edge 26*a*, 27*a* and the inner edge 26*b*, 27*b*. The upper distal end of the respective base edge 26*a*, 27*a* is vertically above the upper distal end of the respective inner edge 26*b*, 27*b* such that the angled edge 26*d*, 27*d* being defined thereby slopes inwardly and downwardly from the inner surface 23 of the side wall 22.

Figure 4A:
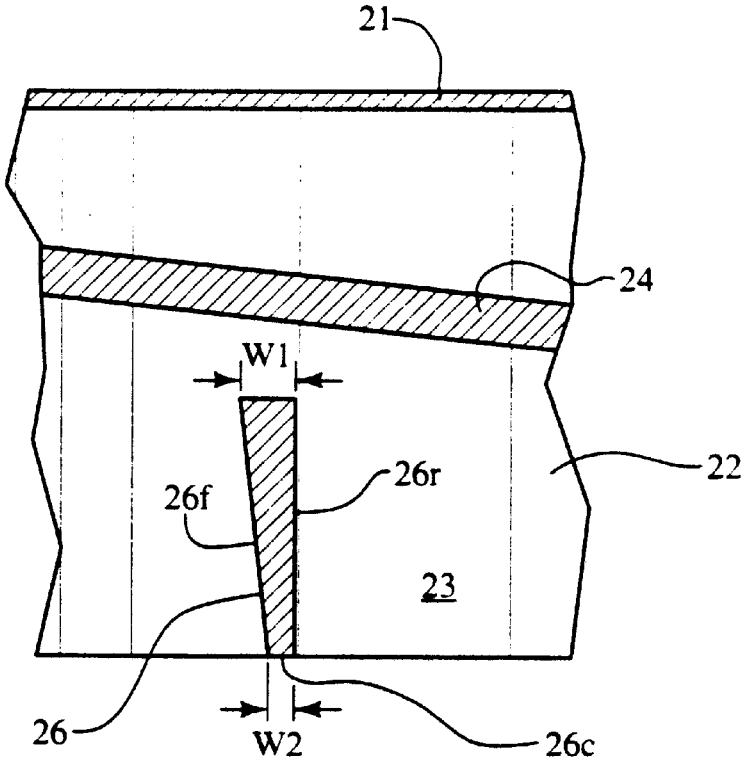
FIG. 4*a* is a detailed section view of one element of the closure of FIG. 1 taken along section 4*a*—4*a* of FIG. 4.

With additional reference to FIG. 4*a*, the locking lugs 26, 27 further include a trapezoidal cross-section, wherein the locking lugs 26, 27 have a thickness "$W_1$" towards the angled edge 26*d*, 27*d* thereof which is greater than a thickness "$w_2$" towards the bottom edge 26*c*, 27*c* thereof.

Figure 6:
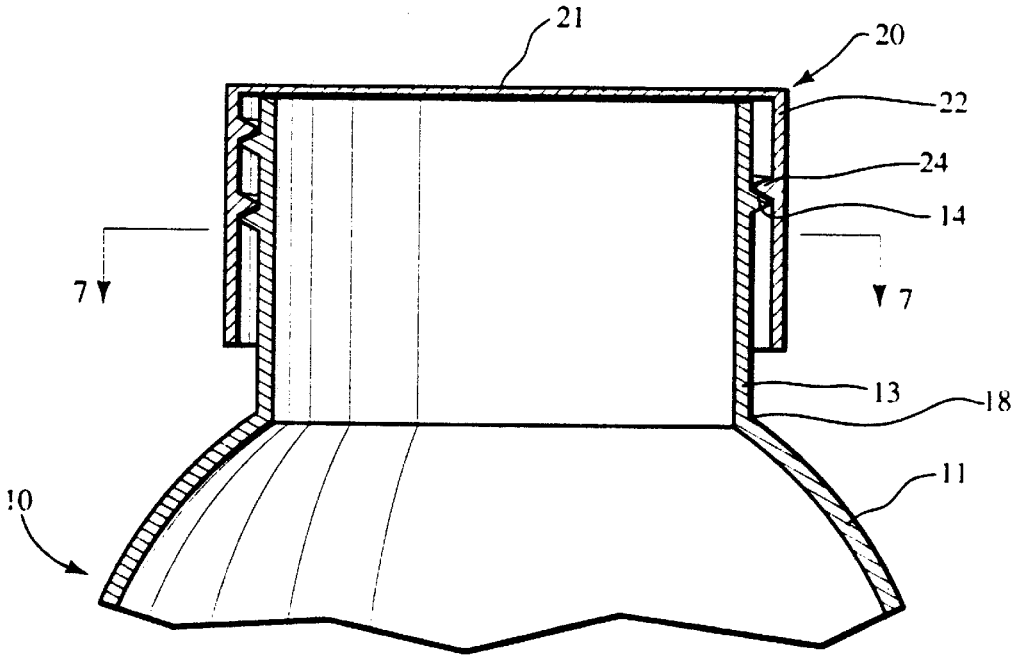
FIG. 6 is section view of the closure and container neck portion of FIG. 1 taken along section line 5—5 of FIG. 3.
Figure 7:
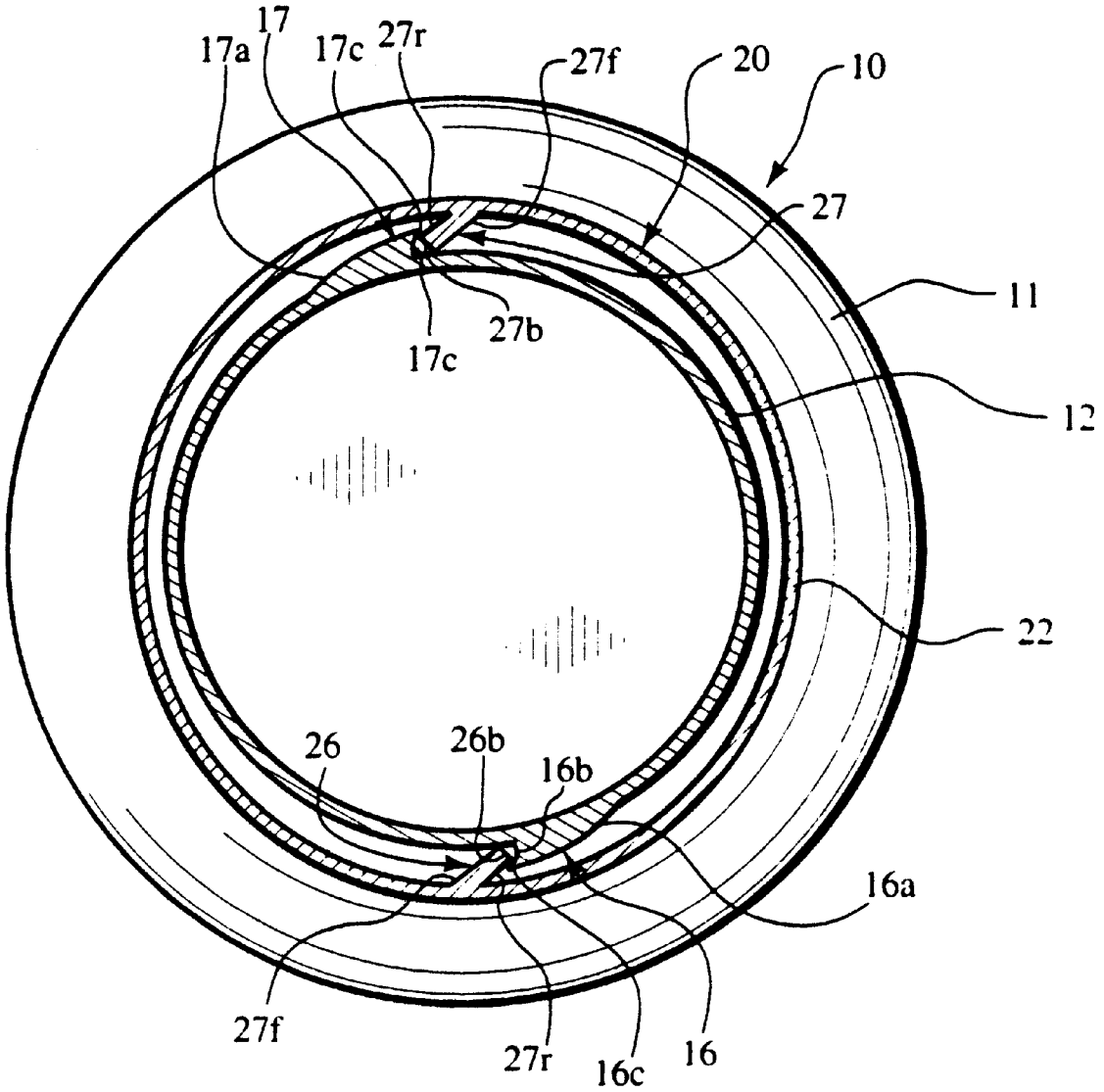
FIG. 7 is a section view of the closure and container neck portion of FIG. 6 taken along section line 7—7 of FIG. 6.

With reference to FIGS. 6 and 7, the closure 20 is threadingly affixed upon the container neck portion 12 so that the closure locking lug front faces 26*f*, 27*f* meet with and abut the respective container locking lug sloped faces 16*a*, 17*a*. Additional rotation of the closure 20 forces the closure locking lugs 26, 27 to flex radially outwardly along the respective sloped faces 16*a*, 17*a* until the closure locking lug inner edge 26*b*, 27*b* passes over and beyond an outermost edge 16*c*, 17*c* of the respective container locking lugs 16, 17, thereby interfering therewith and seating the closure locking lugs 26, 27 behind the respective container locking lugs 16, 17. Removal rotation of the closure 20 forces the closure locking lugs 26, 27 into deeper engagement with the respective container locking lugs 16, 17, thereby preventing removal of the closure 20 from the container neck portion 12.

Removal of the closure 20 from the container neck portion 12 requires a user to first overcome the interference between the closure locking lugs 26, 27 and the respective container locking lugs 16, 17. This is accomplished by applying opposed, inwardly-directed radial forces to an outer surface 29 of the side wall 22 spaced equidistantly between the closure locking lugs 26, 27. The side wall outer surface 29 may include raised or flattened regions in an area surrounding the point of application of the inwardly-directed radial force. In response to the inwardly-directed radial forces, the side wall 22 is displaced radially inwardly in the area surrounding the point of application, forcing the side wall 22 to be displaced radially outwardly in a region surrounding the closure locking lugs 26, 27 a sufficient radial distance to permit the closure locking lug inner edge 26*b*, 27*b* to pass over the container locking lug outermost edge 16*c*, 17*c*. The so-called "squeeze efficiency" (i.e., the ratio of outwardly side wall radial displacement in relation to the amount of inwardly-directed radial force applied thereto) is increased due to the locking lugs' 26, 27 having a free angled edge 26*d*, 27*d*, which permits a greater radial displacement in response to a lesser applied force. Removal rotation of the closure 20 is then applied to unthread the closure 20 from the container neck portion 12 and remove same therefrom.

Molding of the closure 20 is facilitated by the tapered, angled shape of the locking lugs 26, 27.

Figure 8:
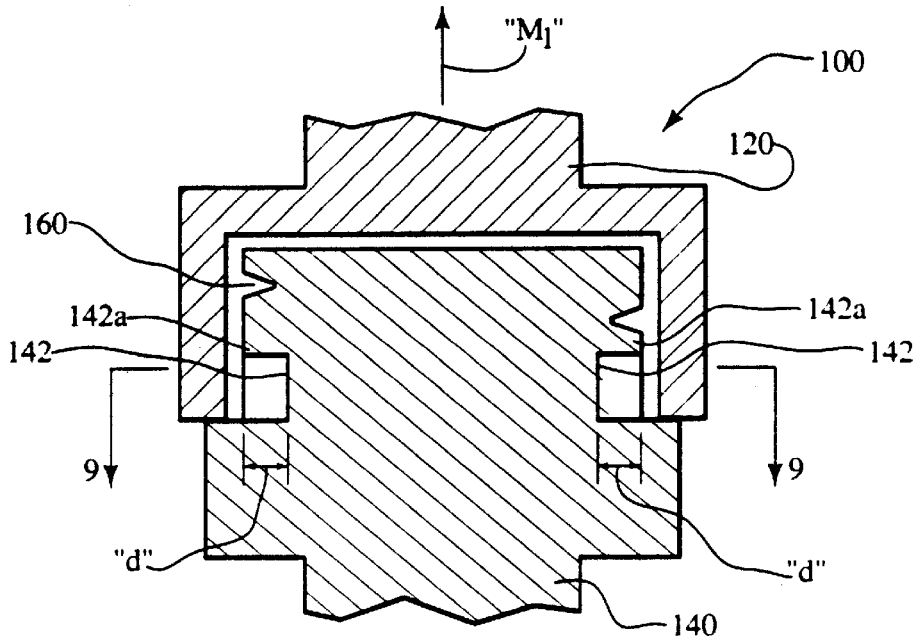
FIG. 8 (PRIOR ART)
FIG. 8 is a section view of a molding die typically used in the prior art.
Figure 9:
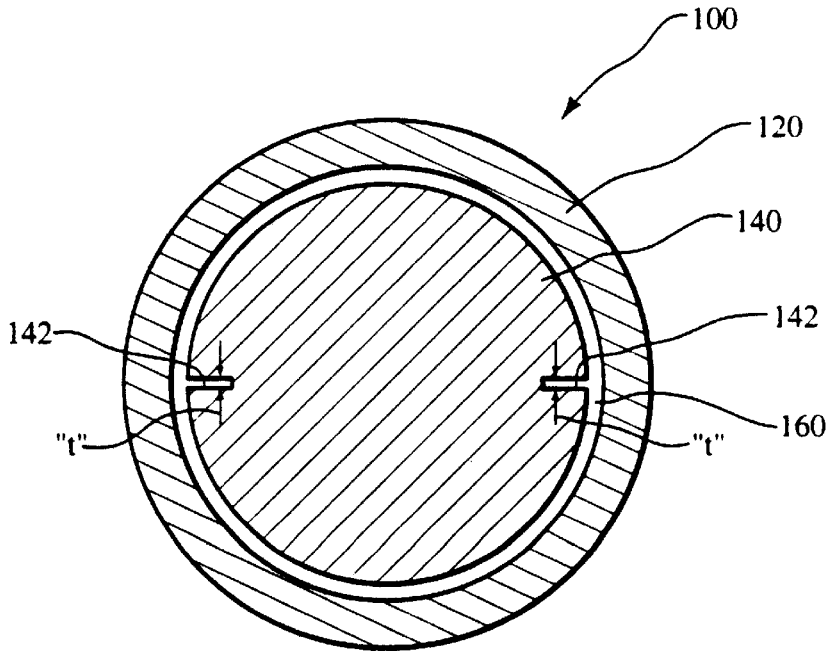
FIG. 9 (PRIOR ART)
FIG. 9 is a section view of the molding die of FIG. 8 taken along section line 9—9 of FIG. 8.
Figure 10:
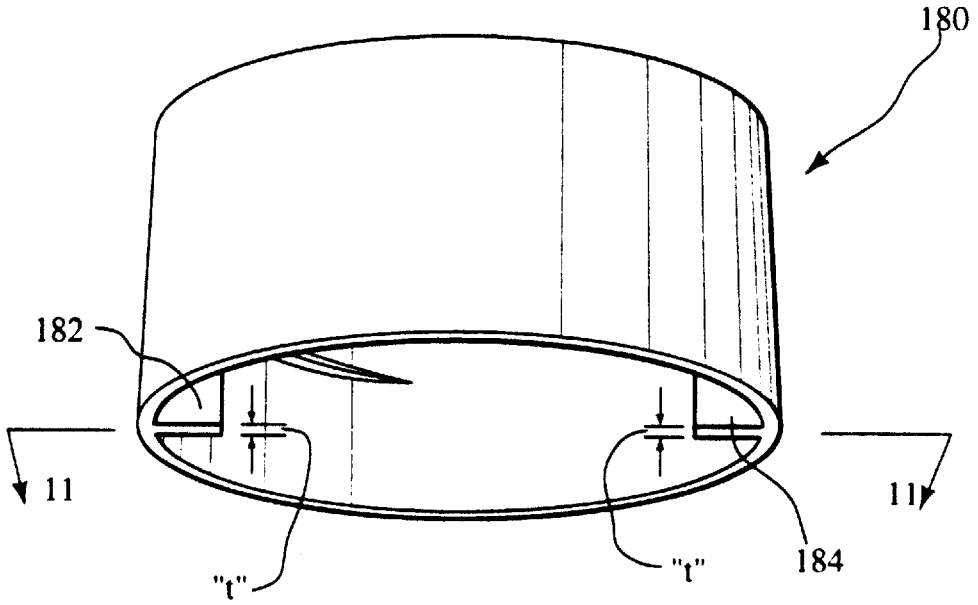
FIG. 10 (PRIOR ART)
FIG. 10 is a bottom perspective view of a closure typical of the prior art molded in the molding die of FIG. 8.
Figure 11:
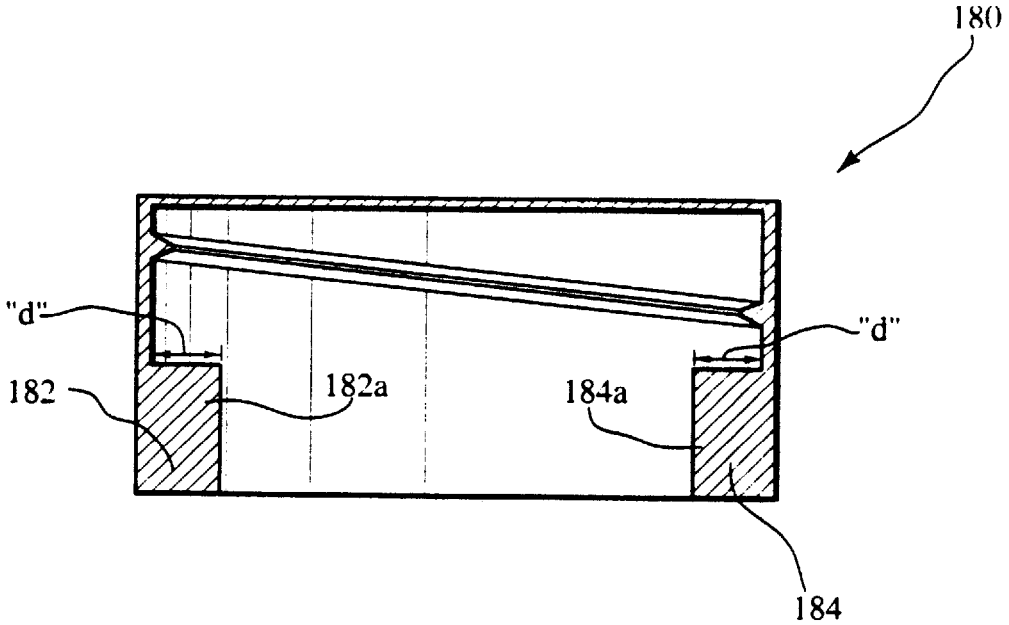
FIG. 11 (PRIOR ART)
FIG. 11 is a section view of the closure of FIG. 10 taken along section line 11—11 of FIG. 10.

With combined reference to FIGS. 8–10, a molding die 100 typically used in the prior art to mold a prior art closure 180 having rectangular inwardly-projecting lugs 182, 184 includes an upper die segment 120 and a lower die segment 140, wherein cooperation of the upper die segment 120 with the lower die segment 140 defines an internal recess 160 having a shape conforming to the shape of the molded prior art closure 180.

More particularly, the lower die segment 140 includes a pair of lug-forming slots 142 having a substantially rectangular profile for forming the prior art locking lugs 182, 184. Typically, the lug-forming slots 142 include a constant thickness "t" and a depth "d" predetermined to provide optimal locking functionality.

Removal of the prior art closure 180 from the prior art molding die 100 is accomplished by first raising the upper die segment 120 in a direction indicated by reference numeral "$M_1$", exposing an outer surface of the closure 180, and during which the molded closure 180 is held in place against the lower die segment 140 by the formed locking lugs 182, 184 being disposed within the lug-formed slots 142. Removal of the prior art closure 180 from the lower die segment 140 of the prior art molding die 100 requires the closure 180 to be forcibly pulled therefrom, oftentimes inducing significant flexural distortion and stress in the closure 180 and in the locking lugs 182, 184 as innermost regions 182*a*, 184*a* of the locking lugs 182, 184 interfere with and pass over outermost edge 142*a* of the lower die segment 140.

Figure 12:
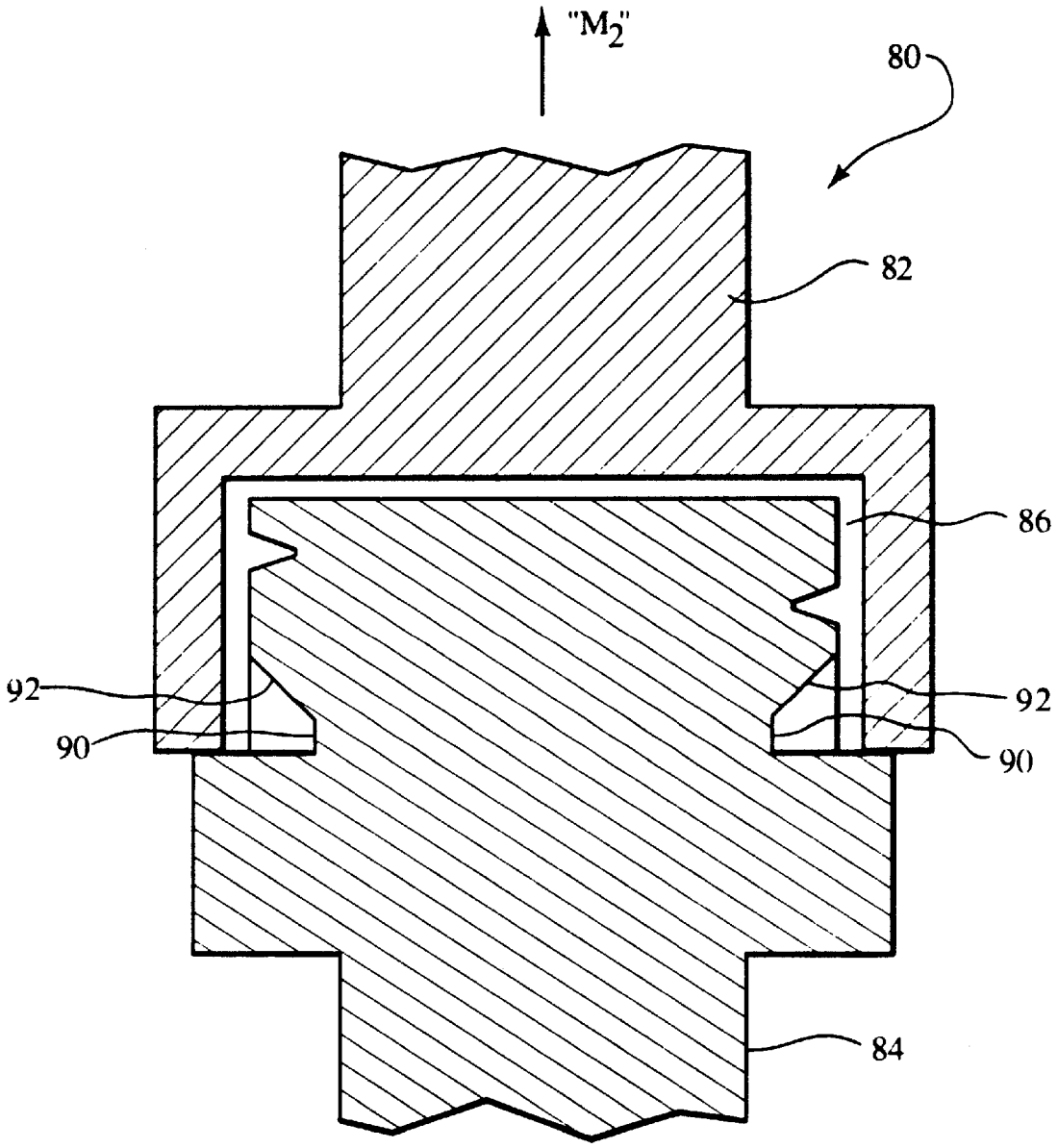
FIG. 12 is a section view of a molding die typically used to mold the closure of FIG. 1; and, FIG. 13 is a perspective view of a closure according to another embodiment of the present invention shown with a neck portion of a container.

With combined reference to FIGS. 4 and 12, the tapered, angled shaped of the locking lugs 26, 27 facilitates removal of the closure 20 according to the present invention from a molding die 80 used to mold same.

The molding die 80 includes an upper die segment 82 being similar to the upper die segment 120 (FIG. 8) used to mold a prior art closure 180, and a lower die segment 84, wherein cooperation of the upper die segment 82 with the lower die segment 84 defines an internal recess 86 having a shape conforming to the shape of the molded closure 20.

More particularly, the lower die segment 84 includes a pair of sloped lug-forming slots 90 having a substantially trapezoidal profile for forming the locking lugs 26, 27. Even more particularly, the lug-forming slots 90 include sloped faces 92 corresponding to the locking lug angled face 26*d*, 27*d*.

Removal of the closure 20 from the molding die 80 occurs by a process of substantially the same steps as heretofore described in removing the prior art closure 180 (FIG. 10) from the prior art molding die 100 (FIG. 8). Firstly, the upper die segment 82 is moved upwardly in a direction indicated by reference numeral "$M_2$", thereby exposing an outer surface of the closure 20 and during which the molded closure 20 is held in place against the lower die segment 84 by the formed locking lugs 26, 27 being disposed within the lug-forming slots 90. Although removal of the molded closure 20 from the lower die segment 84 requires that the closure 20 be forcibly pulled therefrom, distortion of the locking lugs 26, 27 is reduced by the locking lugs inner edge 26*b*, 27*b* being guided over the respective lug-forming slot sloped faces 92. Further, the tapered cross-section of the locking lugs 26, 27 enhances the ease with which the locking lugs 26, 27 slide from within the respective lug-forming slots 90.

Figure 13:
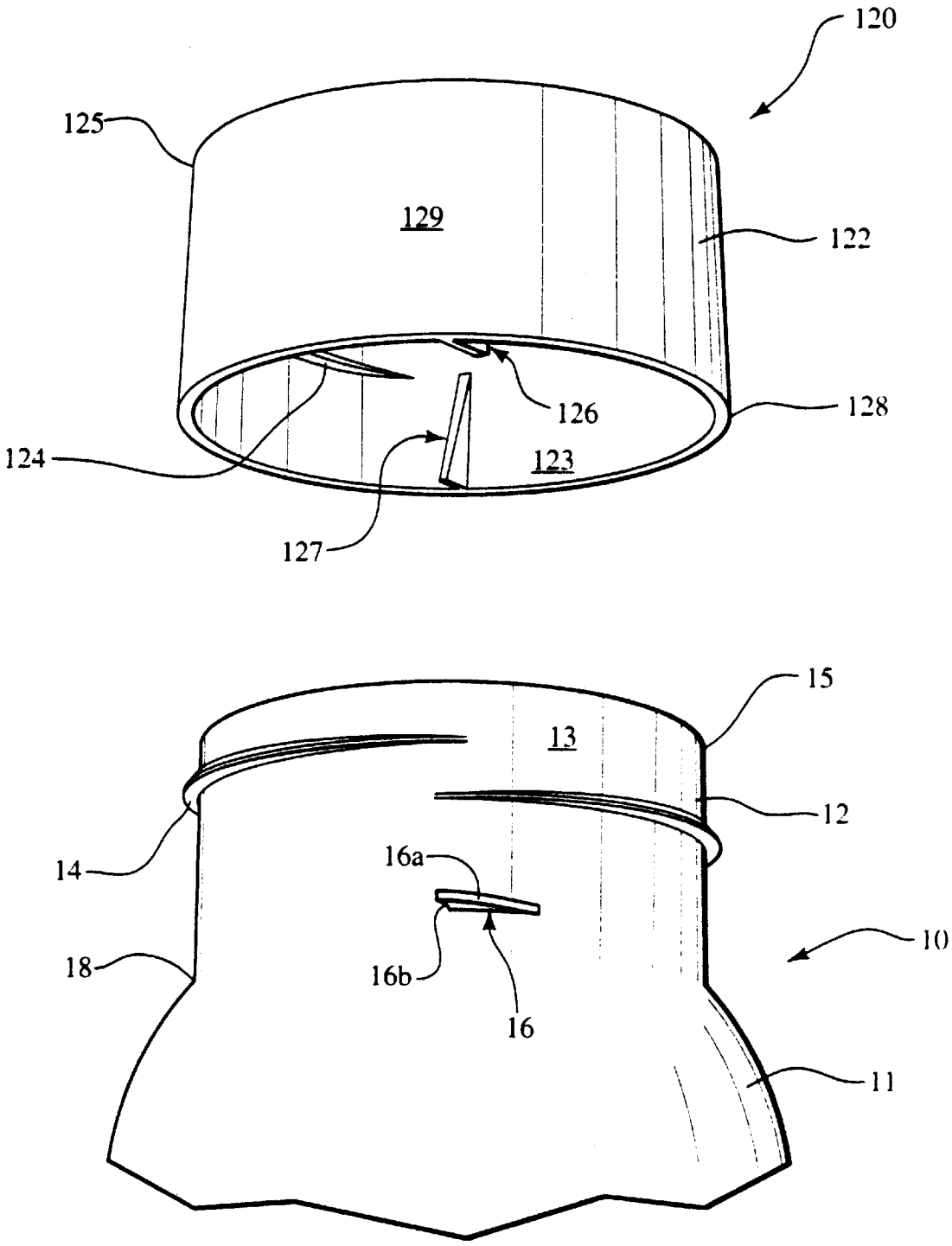

With reference to FIG. 13, a closure 120 according to another embodiment of the present invention includes a top wall 121 having an outer periphery and an annular side wall 122 depending downwardly therefrom and defining a lower end 128 thereof. The side wall 122 includes an inner surface 123, an internal thread 124 disposed towards an upper end 125 of the side wall 122 and projecting inwardly therefrom, and a pair of diametrically-opposed locking lugs 126, 127 disposed towards the lower end 128 thereof and projecting inwardly therefrom. The side wall 122 further includes an outer surface 129, which may have axial ribs, knurls or other similar texturing to enhance a user's grip thereon. The closure internal thread 124 is dimensioned to threadingly engage the external thread 14 of the container neck portion 12, thereby securing the closure 120 to the container 10. The closure locking lugs 126, 127 are dimensioned to matingly engage the respective container locking lugs 16, 17, thereby preventing rotation of the closure 120 relative to the container 10. The closure locking lugs 126, 127 respectively include a substantially triangular profile having a base edge 126*a*, 127*a* integral with and coincident to the inner surface 123 of the side wall 122, a bottom edge 126*c*, 127*c* projecting inwardly from a lower end of the base edge 126*a*, 127*a*, and an angled edge 126*d*, 127*d* connecting an inner end of the bottom edge 126*c*, 127*c* with an upper end of the base edge 126*a*, 127*a*.

The foregoing detailed description is given primarily for clearness and understanding and no unnecessary limitations are to be understood therefrom, for modifications thereto will become obvious to one skilled in the art upon reading this disclosure and may be made without departing from either the spirit or the scope of the present invention.

I claim:

1. A closure comprising:

a top wall;

an annular side wall depending downwardly from an outer periphery of said top wall and defining a lower end thereof opposite said top wall;

at least one lug projecting inwardly from an inner annular surface of said side wall, said at least one lug having a substantially trapezoidal profile, said substantially trapezoidal profile having a base edge coincident with said side wall inner annular surface, a lower edge projecting inwardly from a lower end of the said base edge, an inner edge extending upwardly from an innermost end of said lower edge, and an angled edge connecting an upper end of said inner edge with an upper end of said base edge, said base edge upper end being vertically above said inner edge upper end, said at least one lug having an upper thickness towards said angled edge and a lower thickness towards said lower edge, said upper thickness being greater than said lower thickness; and, an internal thread projecting inwardly from said inner annular surface of said side wall, said internal thread being disposed towards said top wall.

2. The closure according to claim 1, wherein:

said base edge upper end is disposed vertically below said internal thread.

3. The closure according to claim 1, wherein:

said at least one lug is disposed substantially in a plane, said plane defining an acute angle with said side wall inner annular surface.

4. The closure according to claim 1, wherein:

said at least one base edge being disposed along an axis thereof parallel to a central axis of said side wall.

5. The closure according to claim 1, wherein:

said at least one lug inner edge being disposed along an axis thereof parallel to an axis of said base edge.

6. A closure, comprising:

a top wall;

an annular side wall depending downwardly from an outer periphery of said top wall and defining a lower end thereof opposite said top wall;

at least one lug projecting inwardly form an inner annular surface of said side wall, said at least one lug having a substantially triangular profile, said substantially triangular profile having a base edge coincident with said side wall inner annular surface, a lower edge projecting inwardly from a lower end of the said base edge, and an angled edge connecting an inner end of said lower edge with an upper end of said base edge, said at least one lug having an upper thickness towards said angled edge and a lower thickness towards said lower edge, said upper thickness being greater than said lower thickness.

7. The closure according to claim 6, wherein:

said base edge upper end is disposed vertically below said internal thread.

8. The closure according to claim 6, wherein:

said at least one lug is disposed substantially in a plane, said plane defining an acute angle with said side wall inner annular surface.

9. The closure according to claim 6, wherein:

said at least one lug base edge being disposed along an axis thereof parallel to a central axis of said side wall.

* * * * *

UNITED STATES PATENT AND TRADEMARK OFFICE

CERTIFICATE OF CORRECTION

PATENT NO. : 6,152,315
DATED : November 28, 2000
INVENTOR(S) : Gary V. Montgomery It is certified that error appears in the above-identified patent and that said Letters Patent is hereby corrected as shown below:

Title page,
Change item [75] Inventor from "Gary V. Montgomery, Evansville, Ind." to -- Jeffrey C. Minnette, Evansville, Ind. --;

Item [73],
Change item [73] Assignee from "Rexam Plastics Inc., Evansville, Ind." to -- Rexam Medical Packaging, Inc., Evansville, Ind. --.

Signed and Sealed this

Fifth Day of March, 2002

*Attest:*

*Attesting Officer*

JAMES E. ROGAN
*Director of the United States Patent and Trademark Office*